US008555412B2

(12) United States Patent
Aquino et al.

(10) Patent No.: US 8,555,412 B2
(45) Date of Patent: Oct. 15, 2013

(54) UNOBTRUSIVE HIGH-END READY TO WEAR CONCEALABLE BODY AMOR GARMENT

(76) Inventors: Doo Kalmanson Aquino, New York, NY (US); Martha Ellen Pearl, Cherry Hill, NJ (US); Tania Gabbay, Forest Hills, NY (US); Quoc Luyen Pham, Brooklyn, NY (US); Philip Cabrales Kalmanson, Laurel, MD (US)

( * ) Notice: Subject to any disclaimer, the term of this patent is extended or adjusted under 35 U.S.C. 154(b) by 418 days.

(21) Appl. No.: 12/462,306

(22) Filed: Aug. 3, 2009

(65) Prior Publication Data

US 2011/0023201 A1 Feb. 3, 2011

(51) Int. Cl.
*F41H 1/02* (2006.01)
*F41H 1/00* (2006.01)

(52) U.S. Cl.
USPC ..... 2/2.5; 428/911; 89/36.05

(58) Field of Classification Search
USPC ..... 2/2.5
See application file for complete search history.

(56) References Cited

U.S. PATENT DOCUMENTS 2,052,684 A * 9/1936 Wlsbrod ..... 2/2.5
2,424,985 A * 8/1947 Howard ..... 2/2.5
2,517,615 A * 8/1950 Webster et al. ..... 2/2.5
2,743,446 A * 5/1956 Persico et al. ..... 2/2.5
2,747,190 A * 5/1956 Foster ..... 2/2.5
2,748,391 A * 6/1956 Lewis, Jr. et al. ..... 2/2.5
3,061,839 A * 11/1962 Foster ..... 2/2.5
3,337,875 A * 8/1967 Blakeney ..... 2/2.5
3,409,907 A * 11/1968 Barratt ..... 2/2.5
3,452,362 A * 7/1969 Korolick et al. ..... 2/2.5
3,562,810 A * 2/1971 Davis ..... 2/2.5
3,771,171 A * 11/1973 Mitchell ..... 2/2.5
3,843,969 A * 10/1974 George et al. ..... 2/2.5
3,891,996 A * 7/1975 Leach et al. ..... 2/2.5
3,973,275 A * 8/1976 Blauer ..... 2/2.5
3,988,780 A * 11/1976 Armellino ..... 2/2.5
4,266,297 A * 5/1981 Atkins ..... 2/2.5
4,413,357 A * 11/1983 Sacks ..... 2/2.5
4,466,135 A * 8/1984 Coppage, Jr. ..... 2/2.5
4,483,020 A * 11/1984 Dunn ..... 2/2.5
4,485,491 A * 12/1984 Rasmussen ..... 2/2.5
4,497,069 A * 2/1985 Braunhut ..... 2/2.5
4,507,802 A * 4/1985 Small ..... 2/2.5
4,535,478 A * 8/1985 Zufle ..... 2/2.5
4,608,716 A * 9/1986 Brumfield ..... 2/2.5
5,008,959 A * 4/1991 Coppage et al. ..... 2/2.5
5,072,453 A * 12/1991 Widder ..... 2/2.5
5,157,792 A * 10/1992 Allen et al. ..... 2/2.5
5,175,040 A * 12/1992 Harpell et al. ..... 428/113
5,325,537 A * 7/1994 Marion ..... 2/462
5,325,538 A * 7/1994 Schoenweiss et al. ..... 2/2.5

(Continued)

OTHER PUBLICATIONS

Sample of revised amendment practice.*

(Continued)

*Primary Examiner* — Bobby Muromoto, Jr.
(74) *Attorney, Agent, or Firm* — Frederick J. Hamble

(57) ABSTRACT

A ballistic vest-like garment using a torso pattern sloper as a base structure frame so that the garment can be adapted to various types of garments and wearers. Vest-like garment can contain unitary and detachable panels of pliable ballistic material capable of stopping bullets from most handguns. This garment is designed to be used as outerwear that can compliment casual, business, or other professional attire.

1 Claim, 6 Drawing Sheets

(56) References Cited

U.S. PATENT DOCUMENTS

| | | | | |
|---|---|---|---|---|
| 5,327,811 | A * | 7/1994 | Price et al. | 2/2.5 |
| 5,331,683 | A * | 7/1994 | Stone et al. | 2/2.5 |
| 5,471,906 | A * | 12/1995 | Bachner et al. | 2/2.5 |
| 5,495,620 | A * | 3/1996 | Schoenweiss et al. | 2/2.5 |
| 5,495,621 | A * | 3/1996 | Kibbee | 2/2.5 |
| 5,584,737 | A * | 12/1996 | Luhtala | 441/107 |
| 5,970,513 | A * | 10/1999 | Kocher | 2/2.5 |
| 5,974,585 | A * | 11/1999 | Bachner, Jr. | 2/2.5 |
| 6,088,831 | A * | 7/2000 | Jensen et al. | 2/2.5 |
| 6,131,198 | A * | 10/2000 | Westrick | 2/102 |
| 6,233,737 | B1 * | 5/2001 | Ditchfield et al. | 2/2.5 |
| 6,260,196 | B1 * | 7/2001 | van der Sleesen | 2/2.5 |
| 6,704,934 | B2 * | 3/2004 | Graham et al. | 2/2.5 |
| 6,961,958 | B1 * | 11/2005 | Seitzinger | 2/2.5 |
| 7,386,894 | B2 * | 6/2008 | Straiton | 2/228 |
| 7,401,363 | B2 * | 7/2008 | Hatfield et al. | 2/2.5 |
| 7,426,753 | B1 * | 9/2008 | Rivers et al. | 2/2.5 |
| 2002/0069444 | A1 * | 6/2002 | Graham et al. | 2/2.5 |
| 2002/0073473 | A1 * | 6/2002 | Bachner et al. | 2/2.5 |
| 2006/0253950 | A1 * | 11/2006 | Kerr | 2/2.5 |
| 2007/0079414 | A1 * | 4/2007 | Learmont | 2/2.5 |
| 2007/0079416 | A1 * | 4/2007 | Carlson | 2/2.5 |
| 2007/0169244 | A1 * | 7/2007 | Wells, Jr. | 2/2.5 |
| 2007/0234459 | A1 * | 10/2007 | Stewart | 2/2.5 |
| 2008/0098500 | A1 * | 5/2008 | Matic et al. | 2/2.5 |
| 2008/0134419 | A1 * | 6/2008 | Kalaam et al. | 2/463 |
| 2008/0178358 | A1 * | 7/2008 | Learmont | 2/2.5 |
| 2008/0235841 | A1 * | 10/2008 | McDunn et al. | 2/2.5 |
| 2009/0126057 | A1 * | 5/2009 | Rock et al. | 2/2.5 |
| 2009/0151036 | A1 * | 6/2009 | Joseph | 2/2.5 |
| 2009/0211000 | A1 * | 8/2009 | Roux | 2/462 |
| 2009/0255022 | A1 * | 10/2009 | Smith et al. | 2/2.5 |

OTHER PUBLICATIONS

Sample of revised amendment practice, 2003. Previous PTO-892 listed this document but without the date.*

Webposting of Jan. 20, 1999 by Doo Aquino Co., http://ww.mindspring.com/~doo_aquino_co/Doo_aquinoCo.htm.

* cited by examiner

UNOBTRUSIVE HIGH-END READY TO WEAR CONCEALABLE BODY AMOR GARMENT

FIELD OF INVENTION

The present invention relates generally to ballistic armor constructed as a torso frame. The frame has a shell that conceals soft, flexible body armor. The ballistic armor may be comfortably worn about the wearer's torso to provide constant protection against the penetration of bullets from most handguns in the case of a sudden attack. More particularly, the shell of the current invention can be further adapted to any article of clothing such as a jacket, vest, suit and the like. Thus, a concealable protective garment is made more fashionable. Moreover, the shells of the present invention allow a greater degree of flexibility and range of motion for the wearer as compared to other ballistic armor that relies upon rigid plates or stiffened panels.

BACKGROUND OF THE INVENTION

A variety of improvements have been made to the design of concealed body armor garments, so-called "bullet-proof" vests. In the past, many of these garments have been specifically designed for use by police officers as well as the military. Hence, the design considerations of these garments have been concentrated solely on providing lightweight, flexible garments that would protect against death or serious injury from ballistic threats.

Certain examples of the prior art related to concealed body armor garments are:

U.S. Pat. No. 5,331,683 to Stones, et al. ("The '683 patent") describes a protective body armor garment shell in the form of a vest that can be worn over or in place of a standard uniform shirt. The '683 patent claims that the garment shell maintains a degree of professional appearance while concealing to a certain point that body armor is being worn. The vest disclosed by the '683 patent does not fully protect the wearer's side torso. The sides of the wearer are not covered or protected by either the front or back ballistic panels of the garment shell of the '683 patent. In particular, the portion of the wearer's torso immediately beneath their arms remains vulnerable. It is contemplated that if an individual raises either arm, that the corresponding side portion of his upper torso would be exposed to a bullet wound.

U.S. Pat. No. 4,266,297 to Atkins ("The '297 patent") describes a ballistic panel carrier garment in the form of a shirt that has receptacles that permit its wearer to readily install and remove ballistic panels. The associated receptacle of the '297 patent garment are dimensioned to protect at least 75% of the upper torso of the wearer. The shirt disclosed by the '297 patent does not fully protect the wearers upper shoulders and the portion of the wearer's torso immediately beneath their arms. The sides of a wearer are not covered or protected by either the front or back ballistic panels. It is contemplated that if a wearer raises either arm, that the corresponding side portion of their upper torso would be exposed to a bullet wound.

U.S. Pat. No. 3,973,275 to Blauer (The '275 patent) discloses a lightweight flexible garment (The Blauer Vest). The Blauer Vest is intended to be unobtrusively worn under ordinary clothing by military personnel, civilian law enforcement authorities, and the like, to protect against sudden, unexpected handgun attack. The Blauer Vest comprises a plurality of panels of Kevlar™ or similar soft mid-flexible ballistic fabric material, enclosed within a durable outer covering. The panels are joined together to completely encircle the wearer's torso so as to provide protection against attack from any direction.

The Blauer Vest resembles garments of ballistic textile material worn over a standard military uniform shirt used by the military. A desirable objective of body armor vests for use by civilian law enforcement, however, is that they be inconspicuous. If the vest is not concealed from view, an attacker will aim at the head and exposed parts of the body rather than the torso. Thus, this defeats the effectiveness of the protective function of the garment. For this reason, vests like the Blauer Vest are normally worn underneath a standard law enforcement uniform shirt or other outer garment not allowing the vest to "breath." This makes the vest uncomfortable and therefore unsatisfactory for long-term concealed use such as on a day-to-day basis by an ordinary person. The Blauer Vest may also snag or bind on the wearer's outer clothing, thereby inhibiting the wearer's free body movement.

Recent advances in the design and manufacture of ballistic textile materials has made it possible to provide protective apparel that is seasonal, stylish, and relatively lightweight. Until now there has not been available a lightweight, stylish, fashionable, concealable, flexible ballistic body armor that is comfortable and unobtrusive that may be worn under, over or as part of an article of ordinary clothing for long periods of time by an ordinary individual.

Certain high profile individuals such as executives, diplomats, bodyguards, etc. may be under a constant threat of attack by armed individuals. Although these individuals may seek protection in ballistic armor of the prior art, they may lose their professional appearance due to the poor concealability of these aforementioned garments. Furthermore they could not comfortably or realistically wear such heavy and bulky garments as part of their day to day wardrobe Also, such individuals, when attacked, would not have sufficient warning to protect themselves with armored garments of the prior art.

A police officer will still maintain a professional appearance while wearing ballistic armor of the prior art even though the bulk of this armor, as well as its edges, and seams can easily be seen through the officer's shirt. However, a high profile person such as an entertainer or a notable politician would be under closer scrutiny regarding the garments they wear. Thus, if a business person such as a banker or an executive wearing the same ballistic armor as the police officer noted above they would stand out among his or her colleagues. This may detrimentally affect the wearer's professional standing. In addition, an undercover police officer may wish to be protected from ballistic threats without fear that the armor being worn will undermine his/her "cover."

Also, the concealed types of body armor panels of the prior art can become particularly uncomfortable in warm weather as the panels prevent ventilation of the body and restrict moisture removal. Since the body armor may not be worn in hot weather to avoid discomfort, the individual may be at risk.

Therefore a garment that provides ballistic protection but that looks like ordinary everyday wear would be advantageous. The advantage would also be increased if the ballistic armor can take the form of formal, business, or casual wear to further suit the wearer's setting. A further need has arisen for concealable body armor which is convenient to wear, has a professional appearance for civilian users and allows ventilation when worn.

Furthermore the present invention adds to the degree of comfort of the wearer since one garment can be used for the combined purposes of ballistic protection and formal outerwear unlike examples of the prior art where separate garments must be worn, one type providing the ballistic protection and another independent type providing the formal wear typically worn over the ballistic garment.

SUMMARY OF THE INVENTION

What is needed is a new improved vest-like carrier garment modified for use as a base torso structure for frame design that allows this vest-like garment to be adapted for all types of wearable apparel besides vests such as jackets, coats, suits, shirts, etc. Concealable, seasonal, stylish ready-to-wear, protective apparel items can now be available in lightweight fabrics, and unobtrusively worn under or over conventional attire. The vest-like garment sufficiently resembles that of an underlying part of conventional attire, or that of a piece in an ensemble worn over a standard shirt of ready to wear fashion items as to render the vest unobtrusive to the casual observer.

In addition to woven Kevlar fabric layers, ballistic vests have been made from other high strength fibers and composites to reduce weight and improve flexibility of the vest. However, ballistic vests using the lighter, more flexible materials also must offer the required minimum levels of protection against penetration by different types of projectiles.

The torso shape vest-like frame and even the inserted soft body armor of the new improved invention provide satisfactory protection to the body while not adversely impairing the wearer's mobility. The new and improved adapted torso shaped vest-like frame is less bulky and is constructed for balance that can be tolerated for long periods of time.

Despite the fact that fashion is constantly changing, our approach is generic, allowing fashions items to their basic principles. These basic principles and their construction methods are applicable to many variations of a particular style and can be adapted to conform to the dictates of current trends.

Clothes have always been a form of art and design, combining fabrics, color, style, and functionality. Functionality of clothes is not limited to the design and the inclusion of various materials and elements, such as pockets, loops, or the like. These basic principles and their construction methods are applicable to many variations of a particular style and can be adapted to conform to the dictates of current trends. Despite the fact that fashion is constantly changing. For the most part today's clothing, typically includes pockets, belt loops, buttons, buttonholes, snaps, etc., and other design elements that can enhances its functionality.

One object of the invention is to provide a concealable, comfortable, fashionable, seasonal, stylish wearable apparel protection garment that can provide reasonably adequate protection to an individual. The protective material made of a high tensile strength fiber such as a para-aramind like Kevlar™ or a ultra-high molecular weight polyethylene fiber like Spectra™ cut into a torso shape comprised of front, rear, side and center layer panels are sewn together and can be easily inserted or removed from a spacer facilitated opening of the inner layer. Therefore, an object of this invention generally speaking, and from an ergonomic perspective, is to improve and provide a wide variety of stylish, fashionable protective garments in clothes such as vest, jackets and together the garment must also appeal, as it is usually visible. The concealability of this invention resides in its mimicry of the typical type of business or formal garments worn by the general populace.

The advantages of the invention are many. A basic torso pattern sloper is a structure in which various configurations can be manipulated to each desired design-style, fit and form and size of different fabrics are used that can be moldable, to its intended structure shape for providing comfort and ease of movement based on the functional layer of the design structure. Methods of garment constructions, sewing machines applications and ornamental trims, fabrics other used enhancements are employed and described for providing characteristics to a wide variety of everyday wear or formal attire or business attire. It is an object of the of the present invention to provide an adaptive torso vest-like garment with concealable protective body armor, that is functional, fashionable, and stylish, that can be unobtrusively worn.

It is a further object to provide an adaptable torso vest constructed for supporting an ensemble of ready to wear article of clothing to simulate as a regular fashionable garment, the ability to be worn over a shirt, to be part of a suit or that does not detract from the fashion or stylishness or image while providing ballistic protection without losing the advantage of concealment.

It is a further object to provide frame panels with a three dimensional pocket like receptacle for receiving the inserted protective pliable material.

It is another object to provide assemble torso vest independently constructed in its own adaptable design style suitable to incorporate onto other articles of clothing as part of a suit or ensemble. It is a further object to provide assembled vest shell and the adaptive outer design shell being loosely drape, independent in its own movement to ease ventilation, flexibility, and comfort.

In another embodiment, the torso vest frame garment shall be compromised of front and back panels, and rectangular frame panel disposed over a placement carrier, which incorporates the inserted or removable pliable protective body armor panels.

However, detachable front and side's rectangular frame panels both having separable zipper and Velcro fastener. Protective frame covering panels are placed in-between the left front and the right front closable center sections and part of front and back side's rear sections. Left front, left back and side's rear inner panel portion of the opposite adjacent inner layers may have VELCRO™ fasteners and separable zipper attached to complete the assembly.

Protected frames are in placed and secured close to the wearer's body to prevent the garment from shifting when the garment is worn.

The overlapping rectangular front panels are designed to double the wearer's protection to the closable front section beneath the wearer's body to protect heart, lung, kidneys, spleen, spine, and other vital organs within the torso from sudden frontal attack even at close range.

The overlapping rectangular front and side rear panels are protected from the sides of the vest, designed to double the wearer's protection beneath the wearer's body which will stop a close range shot from a small caliber handgun.

Thus, the depth width of the binding receiving receptacles layer, and the thicknesses of the inserted pliable ballistics material to the front frame panel, back panel, and rectangular frame panel are comprised of both measures depending on the degree of comfort and flexibility sought relative to the degree of protection that is required. The panel protective pliable material sheets are made of high tensile strength synthetic fibers such as para-aramids like KEVLAR™ as well as Ultra high molecular weight polyethylene like SPECTRA™.

The underlying torso frame shell is made of lightweight material, either cotton, silk, polyester blend, wool, or any such fabrics as used in an article of clothing to simulate an ordinary garment that is worn as typical office attire or formal attire. Thus, the protective concealable vest by itself can be worn as modish, stylish, or can be incorporate together with any ordinary fashion items such as jackets, coats, suits, etc. . . .

In addition, this provides an ordinary individual with a professional appearance and allows the wearer to keep the protective armor on and in place during the sudden unexpected handgun attack.

The underlying torso shape frame vest of this invention includes front and back panel, and detachable rectangular front and side rear panel. It's front and back shoulder is secured joined at seams, front and back sides is secured joined at side seams, two separable side-rear detachable rectangular panels extending partial front side portion and back side portion, also separable detachable rectangular frame panel construct to center panel extending from the center front over the lateral portions part of the chest and to the waist.

DESCRIPTION OF THE DRAWINGS

Embodiments of the invention have been chosen by way of example for purposes of illustration and description, and are shown in the accompanying drawings, wherein.

DETAILED DESCRIPTION

Those of skill in the art will better understand the preferred embodiments of this invention by reference to the constructed detailed sketch figures. The preferred embodiments of this invention are illustrated in the description where garment constructions of the figures are not intended to be exhaustive or to limit the invention to the precise form disclosed. They are chosen to describe or to best explain the principles of the invention and its application and practical use to thereby enable others skilled in the art to best utilize the invention.

A garment can have any shape, one skilled in the art will appreciate that the torso shape frame and its modified used of garment construction can have its advantages, can be adapted to include the carrier, can be unobtrusive, can be constructed with concealable protection and can be implemented and attached onto other garment such as; jackets, vests, suits, coats, vest jackets, shirt vests, hooded tops, etc. and still practice the invention.

In general, the stylish underlying torso frame shell referred to the current embodiment is preferred to be a carrier vest-like garment.

The adapted shell is designed to closely resemble a standard vest. Preferably, composed of cotton, nylon, polyester, blend or similar material essentially identical to that used to produce a design adapted style or any combination thereof. This allows the shell to match the texture and color as well as the appearance of the garment or to make it more fashionable.

Figure 1:
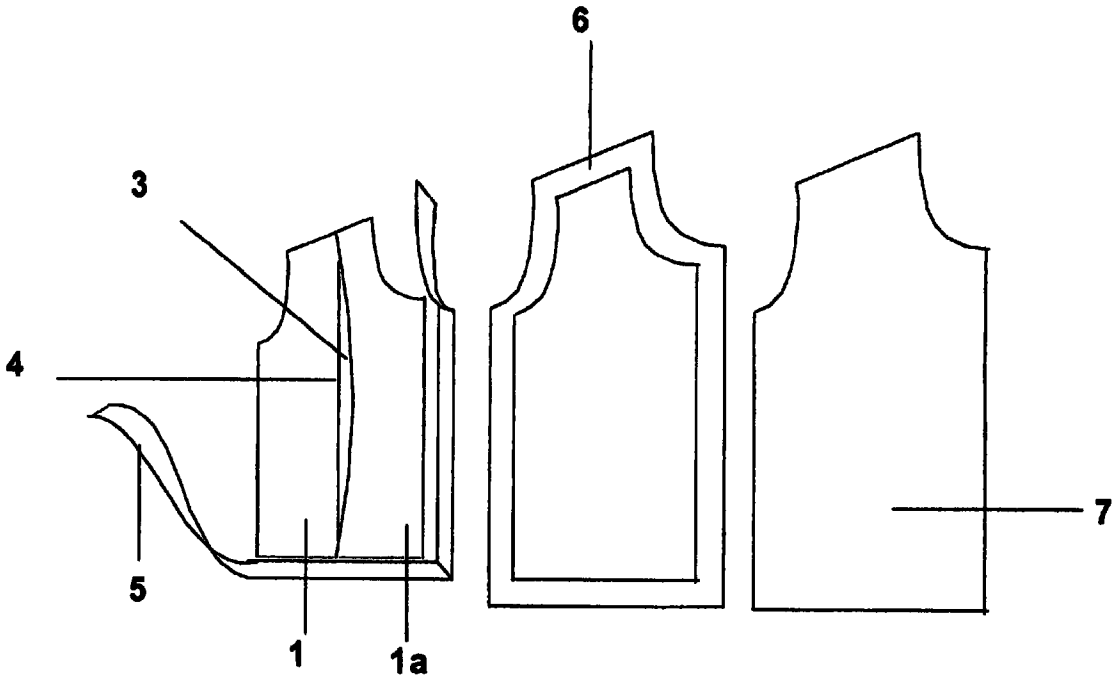
FIG. 1 is a front panel sectional view forming the interior layer section of the inventive shell of the present invention.

Referring to FIG. 1, a front torso shell frame panel is shown having individual successive overlying layers of fabric material: an inner fabric layer; a self trim binding layer 5, a facing layer 6, and an outer fabric layer 7. The inner fabric layer is divided in two sections a front inner right section 1 and a front inner left section 1A. An opening 3 is provided between front inner right 1 and front inner left 1*a* sections. The upper and lower sections of a seam portion 4 are joined A zipper closure 8 (not shown) is provided attached onto the seams section to maintain the section in a closed, open condition allowing the inserted pliable concealable body armor panels 9 (not shown) to be placed into the pocket opening.

A continuous or semi-continuous strip of intermediate self trim binding layer 5 is placed between two layers—inner surface layer and facing layer 6. One edge of self trim binding layer 5 is attached all around outer edge of inner surface layer, assembled sections of 1 and 1A, and the other edge of their self trim binding layer 5 is attached all around to the inside edge of thr partially cut out facing layer 6. The partially cut out facing layer 6 inside edge is identical, i.e., similar in shape, measurements, dimension, and proportion, to the outer edge of inner surface layer sections 1 and 1A.

An outer edge of the partially cut out facing layer 6 is also identical, i.e., similar in shape, measurements, dimension and proportion, to the outer edge of outer layer 7. Outer layer surface 7 forms and acts as the main frame supporting the successive overlying layers: facing layer 6, self-trim binding layer 5 and inner surface layer sections 1 and 1A.

Figure 2:
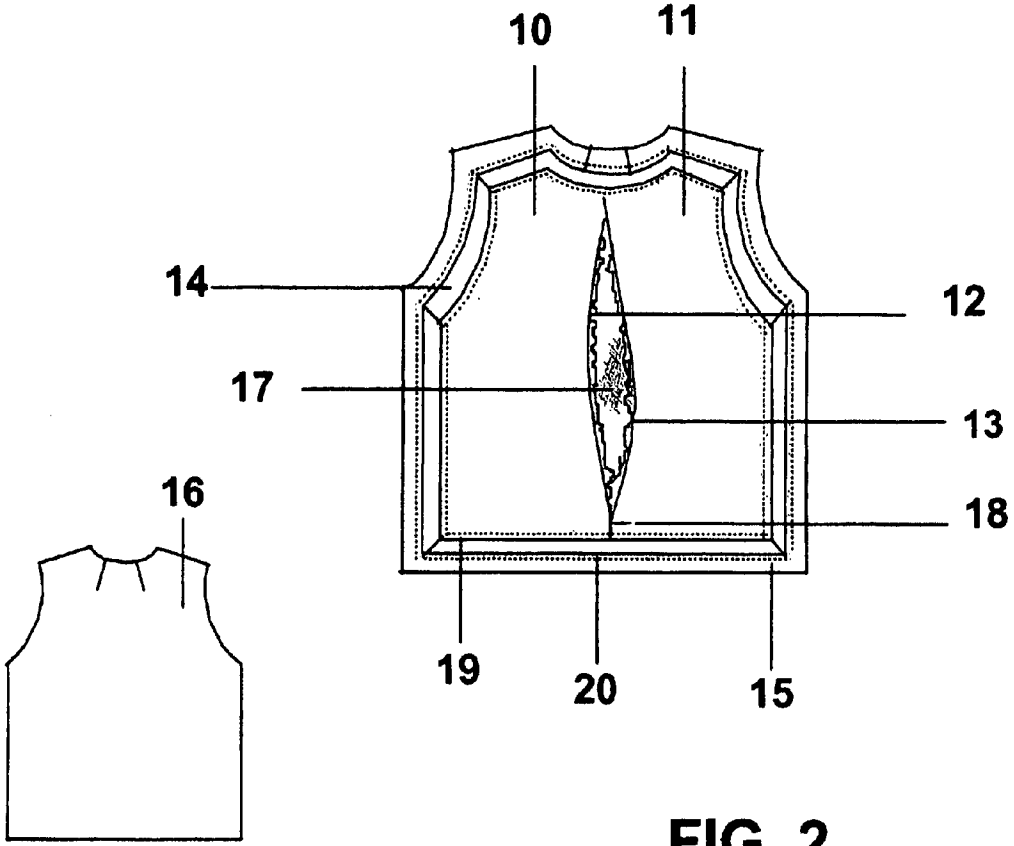
FIG. 2 is a view of an assembled garment shell back inner surfaces of the present invention.

Referring to FIG. 2, the successive individual layers are shown assembled to form a back torso frame similar to FIG. 1. The constructed back panel is similar to the front panel illustrated within FIG. 1. The integrally formed frame back panel is comprised of successive individual layers of fabric materials. These layers include (1) an outer layer (16) which, functions to support the overlying layers; (2) a partially cut out facing layer (15), is framed and attached to outer layer 16 by stitching along their outer edges, (3) a continuous or semi continuous strip of intermediate trim binding layer (14), and (4) an inner fabric layer, made up of two halves in the current embodiment, 10 and 11. Intermediate binding layer forms seams between partially cut out facing layer edge 15 and all around the assembled inner surface layer (10 and 11) outer edge. The attachment of these layers forms a receptacle pocket within. A free spacer in-between of which depth dimension of the receptacle pocket is configured to conform to the size, proportion and thickness of pliable ballistic body armor panels 17. This allows inserted ballistic body armor panels 17 to move freely within the receptacle pocket. The directions of the seams generated between inner surface layer, trim binding layer 14, and facing layer 15 intersect at an angle which allows flexing along said seams.

The back panel portions of the inner surface forms of two sections back inner right section 10 and back inner left section 11. An opening 12 is provided between back inner right section 10 and back inner left section 11 for receiving inserted body armor 17 (shown in phantom). A pair of inseparable zipper closures 18 is attached between seam 13 positions in a kissing relationship to the upper section and lower section of the opening in an open closed relationship. An additional edge stitch 19 is sewn all around along edge of the inner surface and also an additional edge stitch 20 is sewn all around along the partially cut out facing layer 15. The same principle also applies to front panel portion of 21, 21A and 22, 22A as illustrated in FIG. 3.

With these additional seams, any ballistic force will be transmitted to the reinforced stitched seams 19 and 20, applying shear force to inner surface layer 10 and 11 and partially cut out facing surface 15. While these additional reinforced stitched seams provide security to the pocket receptacle, the additional stitched seams do not detract from the garment's appearance.

Figure 3:
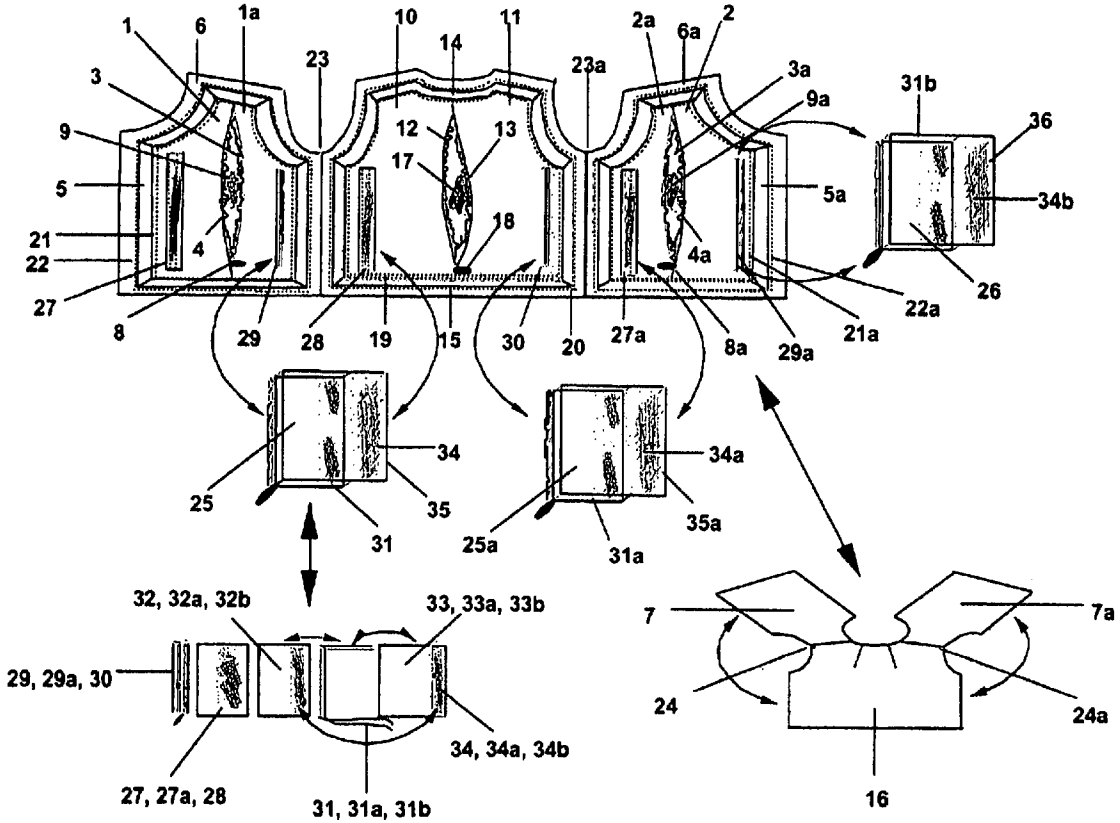
FIG. 3 is a view showing assembled garment shell inner surfaces of FIG. 1 and FIG. 2 as provided with releasable sides' rear flap panel portion and center flap panel portion.

Referring to FIG. 3, a garment shell with front portion panels and a back portion panel in an engaged position. On each side of the vest the connecting seams shoulder portions 24, and 24A, and sides portions 23 and 23A, attached to the front and back portion and form a head opening, neck opening, front opening, and a pair of armhole opening.

Integrally formed front frame panels as shown in FIG. 1, a right front frame panel and a left front frame panel are shown in FIG. 3. The left front frame panel is assembled as illustrated in FIG. 1. The right front frame panel, as illustrated in FIG. 3, includes inner fabric layers 2, 2A. An opening 3 is provided 3, and an inseparable zipper closure 8A is attached between seam 4A. Zipper closure 8*a* maintains opening 3A in an open or closed condition. The inner layer also includes an opposed fastener 27A, and a mating separable zipper closure fastener 29A along opposing front and sides thereof. The inner fabric surface of left front frame panel similarly includes an opposed fastener 27, and a mating separable zipper closure fastener 29 along opposing front and sides thereof. Intermediate trim binding layer 5A of right front panel frame is disposed in-between inner layers 2 and 2*a* and facing layer and has seam directions intersecting at an angle such that seams are capable of flexing. A pocket receptacle is formed through the connection of inner layers 2 and 2A, trim binding layers 5A, and partially cut out facing layer 6A The depth of the pocket receptacle is suitable to allow pliable ballistic body armor panel 9A, to be placed within the pocket receptacle. Outer layer 7A supports the frame of the right front frame panel.

The back panel, as shown in FIG. 2, is similar to the front panels. Back panel is comprised of inner layer sections 10, 11. Opening 12 is provided and a pair of inseparable zipper closures 18 is attached between seams 13 to maintain the opening in an openor closed condition. An intermediate trim binding layer 14 is disposed inbetween, a partially cut out facing layer 15 and inner layer forming a pocket receptacle there between. Outer layer 16 supports the frame of the back panel. The inner layer of the back panel also includes a pair of opposed fasteners 28 and a pair of mating separable zipper closures fasteners 30 along opposing back and sides thereof.

For illustrative purposes, the separable pair of zipper closures are sewn attached into the front, back and sides of the inner surface. Separable fasteners consist of hook and pile fastener strips typically referred to as VELCRO™. Alternatively, equivalent types of hook and pile fastener strips are provided along opposite sides. In additions to hook and pile type of fasteners, other types of separable fasteners could be used with the present invention such as, snaps and hooks.

A detachable protective rectangular shaped pocket-like ballistic receiving receptacle 25, 25A and 26 are also provided attached to the inner surfaces of the adjacent overlaid section in an overlapping relationship partially positioned approximately midway extending the side front right and left chest section and side rear back left and right chest section and respectively at center front right, left center chest section of the wearer's garment increasing the level of protection to the user.

Each rectangular receiving receptacle center flap 26 and side rear flaps 25 and 25A, which may be fabricated of cloth or the like, is comprised of fabrics layers having an outer surface layer 32, 32A and 32B, an inner surface layer 33,33A and 33B and an intermediate strip of trim binding layer 31, 31A, 31B disposed between. These layers form a depth pocket like receptacle. A free spacer placement is defined by intermediate trim binding layer 31, 31A, and 31B and is dimensioned and configured to conform to the size and thickness and the extent level of inserted pliable ballistic armor panel to be contained therein. These inserts provide supplemental protection to vital organs like the heart.

An opening is provided between the layers at side's overlaid sections 35, 35A and 36. A pair of mating separable fasteners 34, 34A, and 34B are provided on the opposites sides of overlaid sections 35, 35A and 36 to maintain the sections in an attached, detached condition.

The outer layer is provided with complimentary types of conventional releasable closures means such as a mated pair of separable zipper closures 29, 29A, 30 and a strip of separable fasteners 27, 27A, 28 are VELCRO™ alternatively, equivalent hooks and pile fastening material. Adjacent front and back inner surfaces section I, IA, 2,2A and 10, 11 are provided with complementary sewn topstitch to the inner surface which cooperates with the fastener. Each fastener is of sufficient length to allow adjustment to conform to fit the user. The same principle also applies to the sides rear front, back and center of the wearer's garment.

Figure 4:
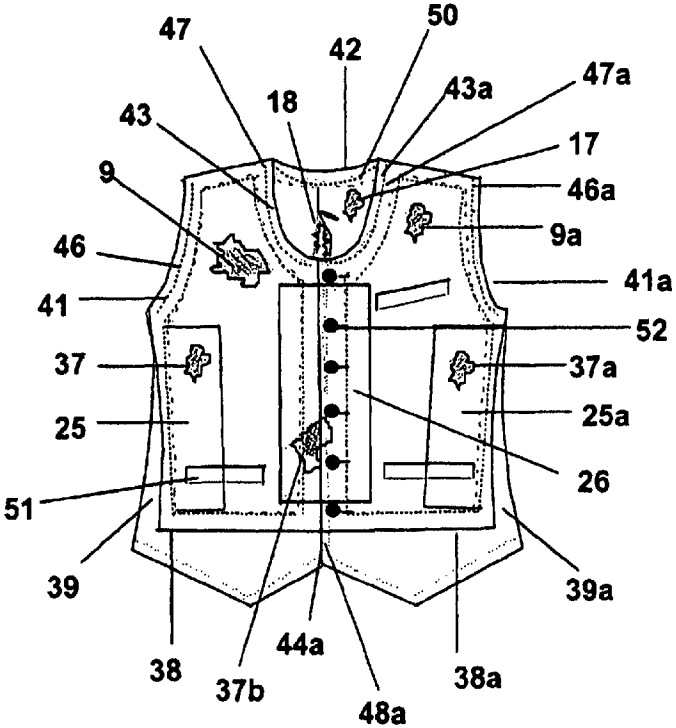
FIG. 4 is a front and back view of the assembled vest in accordance with the present invention as it would placed attached onto the adapted garment.
Figure 4:
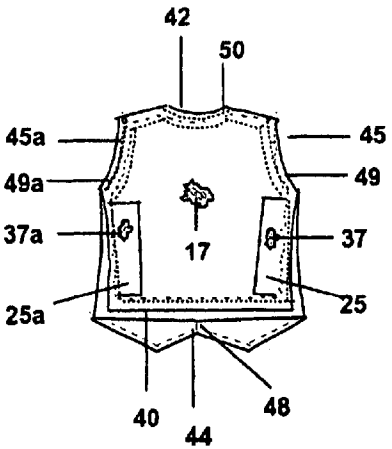

The vest-like garment is best illustrated in FIG. 4. As shown in FIG. 4, façade covers carrier garment disposed beneath the façade. Façade and carrier garment are connected along the edge of the opening circumference of front armholes 41 and 41A, back armholes 45 and 45A, front necks 43 and 43A, a back neck 42 and the closable front portion forming a right half section 44 and a left half section 44A. The connections are formed by sewing or the like along a line adjacent opening to the adapted vest. When the combined garment is worn by the wearer, as illustrated in FIG. 4, the carrier shell fits closely to the wearer's body, and outer facade of the vest garment is loosely draped. The facade is independently draped along sides 39 and 39A, front waist 38 and 38A, and a back waist 40. This arrangement gives the wearer the desired comfort while achieving both fashionable style and protection.

Preferably, the garment shell is composed of cotton, polyester, or similar material essentially identical to that used to produce designer clothes. In combination, this allows the shell to match the texture, and colors as well as the appearance of a design ensemble which includes buttoned closures 52, pockets 51 or various other types of attachments used, or fabricated in vest design. However, it will be best understood that carrier's modified construction may be adapted to any vest or jacket-like garment.

Thus the garment shell vest and the torso frame being draped over the person's adjacent front chest and side rear body maintains the rectangular panel body armor in an overlapping position to protect the side 25,25*a* and front chest 26 areas. If necessary, the designer vest functional front closure button fasteners 52 would be engaged to provide a neat appearance. Since the garment simulates the appearance of a regular designer vest, the individual can maintain a professional appearance yet maximize their protection and comfort. If the individual is wearing a shirt, T-shirt or a sweater beneath this garment shell, he can remove the vest without having to disrobe. Similarly, the designer garment vest can also be quickly applied over a shirt, sweater, jacket, etc., if necessary. This quick on and off feature overcomes a major inconvenience and should increase the utilization of such garments.

Figure 5:
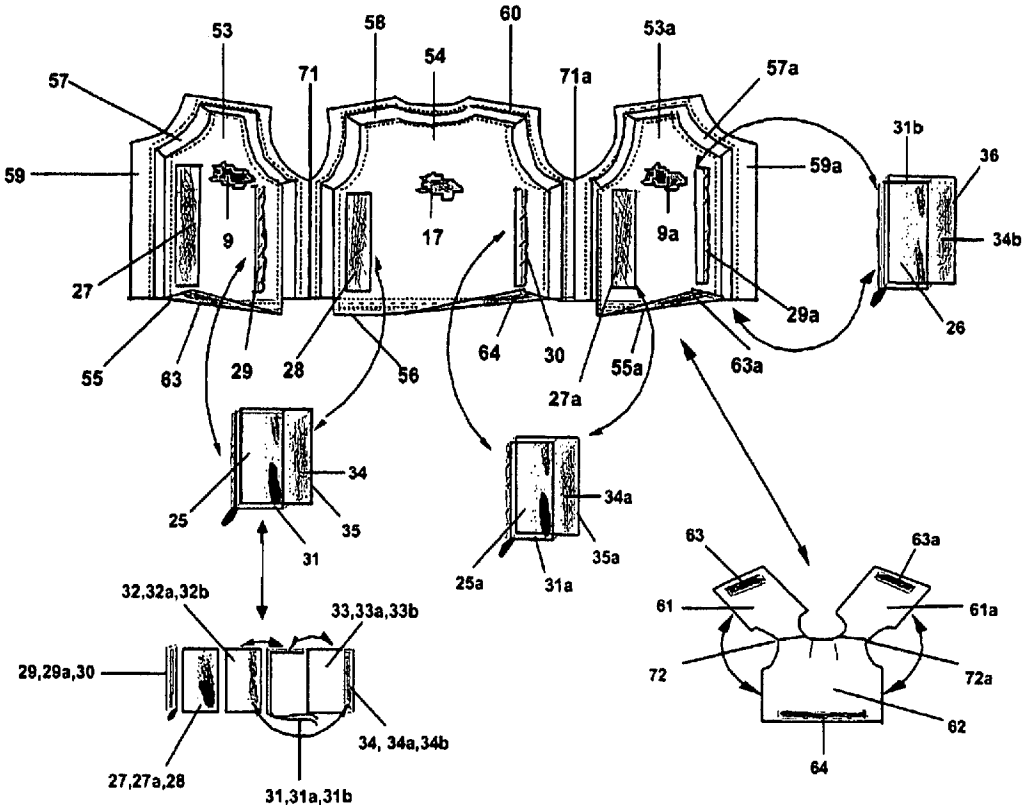
FIG. 5 is another alternative embodiment of the torso vest showing modified construction to front and back section of the present invention.

In the embodiment shown in FIGS. 3 and 5, releasable sides rear front and back 25 and 25A and center carrier panel

26, generally of a rectangular configuration, are attached partially extending to the inner surfaces of right chest section and left chest section and center chest section respectively. Each receptacle, which may be fabricated of cloth or the like, is of a substantially similar configuration and size in order to support inserted pliable ballistic panel 37, 37A and 37B in a manner with respect to the upper torso of the garment wearer.

For example, a garment shell having a front panel with an outer fabric layer and a torso frame with an inner fabric layer may use a pair of separable zipper closures and a pair of mating pile fasteners along the adjacent inner front and adjacent inner side rear, for attachment to the sides of the back inner panels. The front torso frame inner layer and the inner side front and rearward back layers are attached to the rectangular panel.

The separable zipper closure and pair of pile fasteners strips which ease fastening and unfastening of rectangular panel to inner layers along the seams edge. Such a garment shell was subject to ballistic impact and it was found that the impact might cause a force to be exerted on the assembled torso frame, which is transmitted to the seam. When this occurs, the force may be sufficient and cause the inner layer to pull and separable fasteners to peel apart and separate, releasing the detachable rectangular front and side rear panel from the body. Thus, the impact simulates the pulling force used to separate such fasteners.

Another feature of the invention is that the garment shell front panel and the torso frame panels are secured together against the body upon ballistic impact. It was found during testing that detachable rectangular front and side panel must be attached to the torso frame front inner panel and to the side rear torso inner panel in a particular way to avoid separation of the fasteners upon ballistic impact. Should separation occur, there is a potential vulnerability to additional impacts. A modified form of the vest is illustrated in FIG. 5 Referring to FIG. 5, the garment shell shown is similar in construction to the one shown in in FIG. 3, but with a modified extended pocket receptacle form of construction. The vest illustrated in FIG. 5 has front portions and a back portion in engaged condition. The connecting shoulder seams 72, and 72A, and side seams 71 and 71A, attached to the front and back portion and form a head opening, neck opening, front opening and a pair of armhole openings.

As indicated, the front inner surface 53, 53A and back inner surface 54 of the vest lower sections are extended to about 2" to 2½" from the partially cut out frame lateral to the front and back waist. The portion edges of seam where trim binding are sewn together to the inner layer seam edges and to the partially cut out frame layer edges to form a pocket receptacle. Openings are provided 55, 55A, and 56 at the vest's bottom hem and the extended layer are sewn with a mating pair of opposite fasteners. Free spacer within the receptacle is determined only by the width of the trim bindings sewn in-between the inner seam layer and the partially cut out facing layer. The depth of the receptacle is configured to correspond to the thickness of matching panel layers of the protective body armor insert 9, 9A and 17 of the vest.

Figure 6:
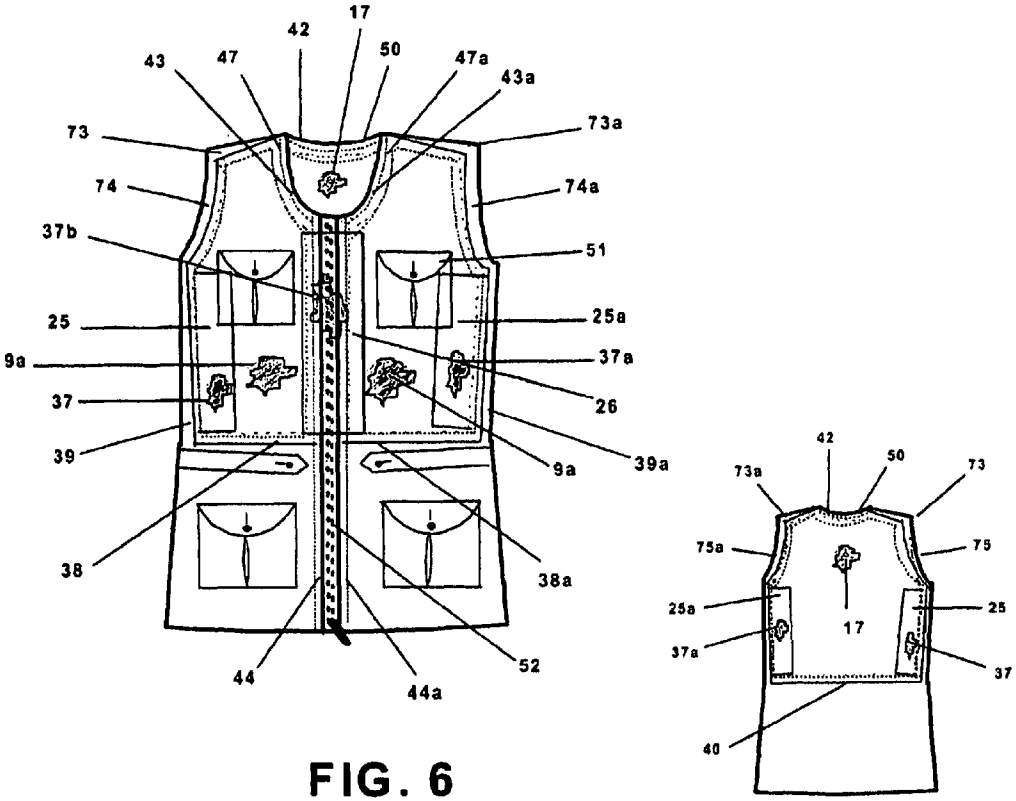
FIG. 6 is a front view of an alternative embodiment showing a modified form of construction in accordance with the present invention, showing the underlying carrier shell as it would be placed attached onto the adapted garment.

In the embodiments shown in FIGS. 4 and 6, the garment shells also include a releasable detachable rectangular carrier receptacle frame panel which extends over the front of the wearer's chest and to the waist. The same principle also applies to the side rear and center of the wearer's torso is dimensioned to serve as a carrier for a flexible ballistic panel.

As shown the front inner surface is similar to the back inner surface having a strip of mated VELCRO™. One surface of the adjacent inner frame layer is provided with one element of a conventional releasable fastening means such as a strip of separable zipper closure and pile fastening material 27,27*a* and 28. These releasable fastening means are sewn to either side of the inner surface layer of the bodice and a pair of mating separable zipper closures fasteners 29 and 29A and 30 are sewn along opposing front and sides thereof adjacent to the rectangular panel section of 25, 25*a* and 26 sections making detachable rectangular frame panel completing its function in attached/detached conditions.

Another feature of the invention is that the garment shell front and back pocket receptacle are secured together. An additional edge stitch 19 is added, sewn all along outer edge of the inner surface. Also, additional edge stitch 20 is sewn all along inner edge of partially cut out facing layer. The same principle also applies to front panel portions of 21, 21A and 22, 22A.

Worn in combination the in accordance with the present invention is best shown in FIG. 6. FIG. 6 shows the underlying carrier shell as it would be placed attached onto an adapted garment, such as a conventional safari vest. It is contemplated that the potential wearer, may already have acquired selected of a great number of ballistic panels of varying size and configuration. Therefore, in view of marketing and economic considerations, it is necessary to adapt the ballistic panel carrier garment of this invention to receive a variety of sizes and configurations of ballistic panels.

As shown the adaptive garment of the present invention and its method of fitting, as disclosed, are needed to support and accurately position a great variety of design variations that are presently available.

The fitting of the ballistic panel carrier garment of this invention to the selected panel in accordance of teachings of this invention is extremely important in that the selected ballistic panel needs to be properly positioned, without shifting, with respect to the upper portion of the wearer's torso. Otherwise, the wearer will be exposed to significant danger in that, portions of his body will be unprotected from ballistic impact. Further, sliding panels may become doubled over causing the garment and its panels to become extremely uncomfortable to wear.

Yet, the Ready to Wear body armor garment shell of this invention have many of the characteristics of ordinary clothing in that it is lightweight, completely dry cleanable, washable and can be tailored to fit the individual user. It can be worn as an ordinary jacket during the fall, winter, summer and spring months under a shirt during the summer months or sweater during the winter months. Note that the co-operating portions of zipper 52 are shown in FIG. 6.

For that purpose, having assembled carrier garment front and back panel portions contains a pair of arm opening, a back neck opening, a front neck opening, a waist opening and a closable front section opening is provided. This facade covers a carrier garment disposed beneath the facade and connected along the edge of the opening circumference of a front neck 43,43A, a back neck 42 and the closable front portion forming a right half section 44 and a left half section 44A by sewing or the like along a line adjacent opening to the adapted garment.

Connecting means for interconnecting the opening seams of the assembled carrier garment front section and the back section, by sewing or the like along a line adjacent opening to the adapted garment front section and back section. Each of the closable front sections is provided with one element of a conventional releasable fastening means, such as a strip of separable zipper closure 52 so that they may be secured to one another in a kissing relationship to close the front of the combined garment over the user's chest and stomach.

When the combined garment is worn by the wearer, as illustrated in FIG. 6 the carrier shell is fitted inside closely to the wearer's body, and outer facade layer of the garment is loosely draped independently along at sides 39,39A at front waist 38,38A in addition, back waist 40 at shoulders 73,73A at front armholes 74,74A and back at armholes 75,75A giving the users increased comfort while achieving fashionable style and protections One object of this invention is to provide a protective Ready to wear carrier garment of the type mentioned that is more comfortable for a person to wear than hitherto known. Another object of this invention is to provide a protective Ready to wear carrier garment of the type mentioned, that provides the wearer with more mobility, unobtrusive style than hitherto known.

In addition, due to the specific construction of the Ready to wear carrier garment, it is very simple to different persons having different torso sizes and waist measurements.

What is claimed is:

1. A ballistic carrier shell comprised of a first front panel having a first pocket receptacle, sized to receive a first pliable ballistic panel, formed by an assembly of a first inner fabric layer, a first intermediate trim binding layer, a first facing layer, and a first outer layer and providing a first opening for the first pliable ballistic panel;

a second front panel having a second pocket receptacle, sized to receive a second pliable ballistic panel, formed by an assembly of a second inner fabric layer, a second intermediate trim binding layer, a second facing layer, and a second outer layer and providing a second opening for the second pliable ballistic panel;

a back panel having a third pocket receptacle, sized to receive a third pliable ballistic panel, formed by an assembly of a third inner fabric layer, a third intermediate trim binding layer, a third facing layer, and a third outer layer and providing a third opening for the third pliable ballistic panel;

wherein the first front panel and the second front panel are separated by a front opening; the first front panel and the back panel are joined at a first side seam and a first shoulder seam, and the second front panel and the back panel are joined at a second side seam and a second shoulder seam; wherein the first side seam or the second side seam are flanked by a first member of a first paired seperable attachment and a first member of a second paired seperable attachment at least one of which is a first half of a seperable zipper attachment;

at least one detachable panel having a fourth pocket receptacle sized to receive a fourth pliable ballistic panel formed by an assembly of a fourth inner fabric layer, a fourth intermediate binding layer, a fourth outer layer and having a fourth opening; wherein the detachable rectangular panel further has a second member of a first paired seperable attachment and a second member of a second paired seperable attachment at least one of which is a second half of seperable zipper attachment, wherein the at least one detachable panel provides ballistic protection across the first side seam or the second side seam when the first half and second half of the first paired seperable attachment are paired, and the first half and second half of the second paired separable attachment are paired; wherein at least one of the paired seperable attachments is an attachment of the first half and second half of the seperable zipper attachment.

* * * * *